United States Patent [19]

Kashiwadani et al.

[11] Patent Number: 4,836,980

[45] Date of Patent: Jun. 6, 1989

[54] METHOD OF SINTERING AN INJECTION-MOLDED ARTICLE

[75] Inventors: Nobuo Kashiwadani, Nara; Hitoshi Ohta, Sakai, both of Japan

[73] Assignee: Chugai Ro Co., Ltd., Osaka, Japan

[21] Appl. No.: 147,345

[22] Filed: Jan. 22, 1988

[30] Foreign Application Priority Data

Jan. 26, 1987 [JP] Japan ..... 52-15583

[51] Int. Cl.[4] ..... B22F 1/00

[52] U.S. Cl. ..... 419/36; 264/65; 419/37; 419/53; 419/54; 419/57; 419/58

[58] Field of Search ..... 419/36, 37, 57, 58, 419/53, 54; 264/65

[56] References Cited

U.S. PATENT DOCUMENTS

| | | | |
|---|---|---|---|
| 4,604,259 | 8/1986 | Whitman | 419/57 |
| 4,608,225 | 8/1986 | Sakaramoto et al. | 419/58 |
| 4,622,068 | 11/1986 | Rowe et al. | 419/58 |
| 4,637,900 | 1/1987 | Frederickson | 419/57 |
| 4,722,826 | 2/1988 | Poole | 419/57 |

FOREIGN PATENT DOCUMENTS

| | | |
|---|---|---|
| 57-123902 | 8/1982 | Japan . |
| 58-153702 | 9/1983 | Japan . |

*Primary Examiner*—Stephen J. Lechert, Jr.
*Attorney, Agent, or Firm*—Wenderoth, Lind & Ponack

[57] ABSTRACT

In a method of sintering an injection-molded article of raw material powder and organic binder, the injection-molded article already debinderized is initially heated up to a certain reaction temperature at which residual binder is removed from it. In subsequent decarburizing step, the residual binder is removed from the molded article under atmospheric or reduced pressure, while being supplied with $H_2$ gas. Thereafter, in a reducing and sintering step, the molded article is heated up to a sintering temperature and is held at this temperature under reduced pressure for a predetermined period, with $H_2$ gas being supplied. $H_2$ content of the atmosphere in the decarburizing step is kept higher than that in the reducing and sintering step.

4 Claims, 1 Drawing Sheet

METHOD OF SINTERING AN INJECTION-MOLDED ARTICLE

BACKGROUND OF THE INVENTION

1. Field of the Invention

The present invention generally relates to a method of sintering an injection-molded article of metallic or ceramic powder an more particularly, to a method of sintering an injection-molded article, for example, of stainless steel powder having a marked tendency to be oxidized.

2. Description of the Prior Art

Conventionally, a method of sintering an injection-molded article is often employed in producing an article which requires high density, high strength and high accuracy. The injection-molded article is generally made of raw material powder and organic binder.

In this method, the raw material powder of Fe-Ni, SUS (stainless steel: JIS G 4311), ceramics or the like is initially mixed and stirred with the organic binder and is injection-molded together therewith by an injection molding machine so that an injection-molded product or article formed in a desired configuration may be obtained. The majority of the binder is then dissolved and removed from the molded article by heating it, and thereafter, the molded article is sintered by being heated up to a sintering temperature of the raw material powder.

The raw material powder employed in this method is different from that to be sintered through a certain molding process other than the injection molding process. Since the raw material powder employed in this method is of minute powder comprising substantially spherical particles, whose diameter is less than 10 microns, it is sintered by using a method disclosed, for example, in Japanese Patent Laid-open Application (Tokkaisho) No. 57-123902.

More specifically, this sintering method comprises a debinderizing step of dissolving and removing the majority of the binder from the injection-molded article, a decarburizing step of dissolving and removing residual binder from the molded article, and a reducing and sintering step of sintering the molded article with an oxide formed during the removal of the binder being removed or reduced.

The decarburizing step and the reducing and sintering step are carried out under the atmospheric pressure within a certain atmosphere of mixed gas comprising inert gas (Ar gas or the like) and reducing gas ($H_2$ gas or the like). During these steps, the molded article is heated while the dew point of the atmosphere within a furnace is controlled in compliance with the kind of molded article to be treated.

In the above described conventional method, since the molded article is treated within the atmosphere gas under the atmospheric pressure, heat loss through a furnace wall is relatively large, thus resulting disadvantageously in low heat efficiency. In treating a material, for example, SUS (stainless steel) including Cr of the like which has a marked tendency to be oxidized, it is necessary to keep the dew point of the atmosphere within the furnace at a temperature of approximately −60° C. during the reducing and sintering step. This dew point of the atmosphere can be hardly maintained in the above descibed method to be executed within the atmosphere under the atmospheric pressure. Even if possible, such a method is disadvantageous in that much time is required for the treatment and high-performance equipment is inevitably needed at increased cost.

The present invention has been developed in view of the following points:

(1) an oxide film formed on the surface of the raw material powder should be limited to the minimum during the decarburizing step of removing the residual binder so that subsequent reducing and sintering step can be readily executed within a short time;

(2) the heating under reduced pressure raises the heat efficiency, and promotes pyrolysis of the binder and restrains the oxide from growing during the decarburizing step;

(3) through the heating under the reduced pressure, the reduction of the oxide is promoted during the reducing and sintering step; and (4) the decarburizing and reducing ability of the atmosphere within the furnace is kept effectively when it is successively or intermittently exhausted.

SUMMARY OF THE INVENTION

Accordingly, the present invention has been developed with a view to substantially eliminating the above described disadvantages inherent in the prior art method of sintering an injection-molded article, and has for its essential object to provide an improved sintering method for an injection-molded article which has high heat efficiency and is capable of shortening time required for treatment as a whole.

Another important object of the present invention is to provide a sintering method described above which is readily controllable.

A further object of the present invention is to provide a sintering method described above whereby a high-performance sintered article can be mass-produced in bulk at reduced cost of equipment and at reduced running cost.

In accomplishing these and other objects, according to one preferred embodiment of the present invention, there is provided a method of sintering an injection-molded article of raw material powder and organic binder, said method including the following steps:

(1) a step of heating the injection-molded article already debinderized up to a reaction temperature at which residual binder is removed therefrom, this step being executed within non-oxidizing atmosphere;

(2) a decarburizing step of removing the residual binder under atmospheric or reduced pressure, with $H_2$ gas or mixed gas of $H_2$ gas and Ar gas being supplied; and (3) a reducing and sintering step of heating the injection-molded article up to a sintering temperature and of holding it at this temperature under reduced pressure for a predetermined period, with $H_2$ gas being supplied.

In the above-mentioned method, $H_2$ content of the atmosphere in the decarburizing step is kept higher than that in the reducing and sintering step.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 1:
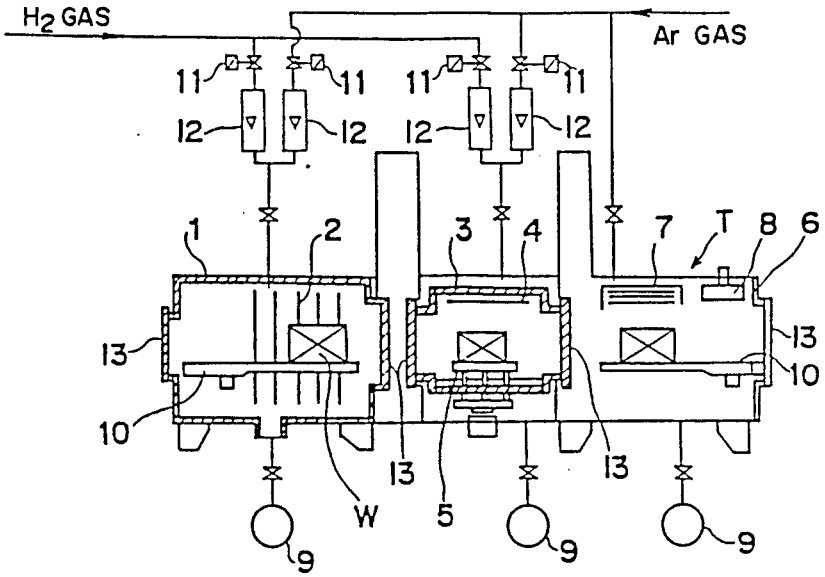
FIG. 1 is a schematic diagram of a sintering furnace employed in producing an injection-molded article in accordance with a method of the present invention.

Referring first to FIG. 1, a sintering furnace T is generally provided with a decarburizing chamber 1, a sintering chamber 3 and a cooling chamber 6, with the sintering chamber 3 being interposed between the decarburizing chamber 1 and the cooling chamber 6. The decarburizing chamber 1 accommodates a plurality of heaters 2 on its side wall. The sintering chamber 3 is internally provided with a plurality of heaters 4 on its ceiling and floor portions and a vertically movable workpiece platform 5 at its bottom portion. The cooling chamber 6 accommodates a gas cooler 7 and a recirculation fan 8 on its ceiling portion.

All the chambers 1, 3 and 6 are of a vacuum construction and are each connected to a vacuum pump 9 through a valve. Both the decarburizing chamber 1 and the cooling chamber 6 each further accommodate a known traverser 10 movable towards the inside of the sintering chamber 3 so that a workpiece W may be transported onto or removed from the workpiece platform 5. The decarburizing chamber 1 and the sintering chamber 3 are each provided with two vertically movable doors 13 at their respective ends, whereas the cooling chamber 6 is provided with one vertically movable door 13 at its discharge end.

Both the decarburizing chamber 1 and the sintering chamber 3 are connected to an Ar gas source and an $H_2$ gas source through respective flow control valves 11 and flow meters 12. The cooling chamber 6 is connected only to the Ar gas source by way of a valve.

Raw material powder is initially mixed and stirred with organic binder in a predetermined ratio and is injection-molded together therewith by an injection molding machine so that an injection-molded product or article W may be obtained. The injection-molded article W is heated within certain atmosphere (air, inert gas, such an atmosphere gas under reduced pressure, or the like) so that approximately 80 to 95% of the organic binder may be removed. This step is called debinderizing step. The step up to this is executed in a conventionally known manner.

The molded article W is then charged into the decarburizing chamber in which it is heated by the heaters 2 up to a reaction temperature of 730° to 750° C. required for removing residual binder within non-oxidizing atmosphere of Ar gas at reduced pressure of 1 to 50 Torr. When the molded article W has been heated up to the aforementioned reaction temperature, the Ar gas atmosphere is replaced by the $H_2$ gas atmosphere, with the reaction temperature being kept substantially constant. Thereafter, the molded article W is heated within the $H_2$ gas atmosphere under the pressure of 50 to 760 Torr so that the residual binder may be removed therefrom. In this case, the $H_2$ gas is successively or intermittently supplied into the decarburizing chamber 1, with the atmosphere within the chamber 1 being simultaneously successively or intermittently exhausted. As a result, carbon contained in the residual binder readily reacts with the $H_2$ gas to produce methane ($CH_4$), which is swiftly exhausted from the chamber 1. Furthermore, an oxide film to be formed on the raw material powder is limited to the minimum by controlling the pressure within the decarburizing chamber 1 and the flow of $H_2$ gas supplied thereto.

Upon completion of the decarburization, the molded article W is charged into the sintering chamber 3 after the pressure in the decarburizing chamber 1 has been rendered substantially to the same level as that in the sintering chamber 3. The atmosphere within the sintering chamber 3 is purged and replaced by the $H_2$ gas, as in the decarburizing chamber 1. The $H_2$ gas atmosphere within the sintering chamber 3 is kept at the reduced pressure of 1 to 100 Torr. In this chamber 3, the molded article W is heated up to a sintering temperature of 1200 to 1300° C. by the heaters 4 and is kept at this temperature for a predetermined period so that it may be reduced and sintered. Even in this case, the $H_2$ gas is successively or intermittently introduced into the sintering chamber 3, with the atmosphere within the chamber 3 being simultaneously successively or intermittently exhausted. Consequently, the oxide formed on the raw material powder is liable to be reduced. As described above, since the oxide film on the molded article W is restrained from growing during the decarburizing step, much time is not required for reducing the oxide film in the sintering chamber 3, thus resulting in shortening of the reducing and sintering period. In addition, since the reducing and sintering step is executed under the reduced pressure, heat loss is desirably low, as compared with the conventional manner. Accordingly, the foregoing reducing and sintering step can be executed in higher heat efficiency within a shortened period.

Thereafter, the molded article W is charged into the cooling chamber 6 to be cooled therein by the Ar gas atmosphere at the pressure of 760 Torr so that a desired molded article may be obtained.

Figure 2:
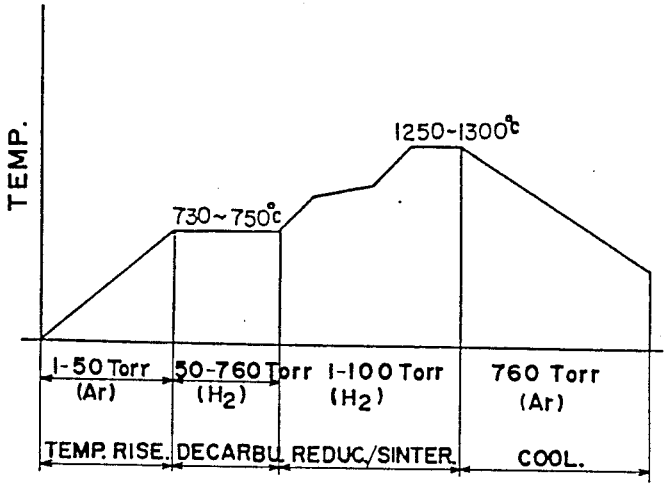
FIG. 2 is a graph showing one example of a heat cycle obtained in the sintering furnace of FIG. 1.

FIG. 2 is a graph indicating one example of a heat cycle described in accordance with the foregoing method of the present invention.

The above described sintering treatment has been executed with respect to a molded article of a plate having dimensions of 10×50×2t under the conditions as shown in Table 1, with the plate being made of the raw material powder of SUS 304L and 316L (JIS G 4311) and the organic binder.

TABLE 1

| | | | | |
|---|---|---|---|---|
| Decarburizing Step: | | | | |
| Heat. | | 5 hrs | Ar gas | 1–3 Torr | 5 l/min |
| Temp-Hold. | 730° C. × | 8 hrs | $H_2$ gas | 600 Torr | 20 l/min |
| Reducing and Sintering Step: | | | | |
| Heat. | | 8 hrs | $H_2$ gas | 10–20 Torr | 5 l/min |
| Temp-Hold. | 1250° C. × | 2 hrs | $H_2$ gas | 10–20 Torr | 5 l/min |
| Cooling Step: | | | | |
| Cool. | | 5 hrs | Ar gas | 760 Torr | |

Under the conditions as indicated above, the sintering treatment has been executed within 28 hours. The sintered article has presented substantially the same mechanical properties as those of a rolled stainless steel generally in use. More specifically, the sintered article have had tensile strength of 45 kg/mm$^2$ and elongation of 37 to 38%.

On the contrary, in the conventionally known manner, the sintering treatment has needed as long as 100 to 130 hours and the sintered article obtained is inferior both in tensile strength and in elongation to that obtained through the method of the present invention.

From the foregoing, according to the method of the present invention of sintering the injection-molded article, since at least the reducing and sintering step is carried out under the reduced pressure through the heating, not only the heat efficiency is high but also time required for treatment can be shortened as a whole.

The atmosphere within the furnace is readily controllable during the decarburizing step and the reducing and sintering step, only by regulating the flow of $H_2$ gas and the pressure within the decarburizing and sintering chambers, without any necessity of annoyingly controlling the dew point of the atmosphere.

Furthermore, carbon contained in the residual binder readily reacts with the $H_2$ gas to produce methane ($CH_4$) and an oxide film to be formed on the raw material powder is limited to the minimum during the decarburizing step. The reduction of the oxide film is promoted during the reducing and sintering step. These advantages are attained by the fact that the $H_2$ gas is repeatedly supplied into and exhausted from the decarburizing and sintering chambers.

Accordingly, time required for the reducing and sintering step can be shortened, while the atmosphere within the sintering chamber is effectively readily rendered to be a region for reducing the molded article, since the reducing and sintering step is carried out under the reduced pressure.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A method of sintering an injection-molded article of raw material powder and organic binder, said method comprising:

heating, within a non-oxidizing atmosphere, the injection-molded article which has already been debinderized;

decarburizing and removing residual binder from said injection-molded article at a reaction temperature up to the temperature at which said injection-molded article has been heated in the previous step, with $H_2$ gas or mixed gas of $H_2$ gas and Ar gas being supplied herein; and reducing and sintering said injection-molded article by heating up to a sintering temperature and holding said injection-molded article at said sintering temperature under reduced pressure for a predetermined period, with $H_2$ gas being supplied, wherein the $H_2$ content of the atmosphere in said decarburizing step is maintained in an amount higher than that in said reducing and sintering step.

2. A method as claimed in claim 1, wherein said reducing and sintering is carried out under the reduced pressure of 1 to 100 Torr.

3. A method as claimed in claim 1, wherein said injection-molded article comprises stainless steel powder.

4. A method as claimed in claim 3, wherein said reducing and sintering is carried out under a reduced pressure of 1 to 100 Torr.

* * * * *